United States Patent [19]

Gotanda

[11] 4,205,328

[45] May 27, 1980

[54] APPARATUS FOR CONTROLLING A POWER SOURCE FOR AN ELECTRICAL ALARM OR INDICATOR

[76] Inventor: Motohiro Gotanda, No. 3-6-29, Inokashira, Mitaka-City, Tokyo, Japan

[21] Appl. No.: 867,947

[22] Filed: Jan. 9, 1978

[30] Foreign Application Priority Data

Jan. 20, 1977 [JP] Japan ..... 52/4680[U]

[51] Int. Cl.[2] ..... G08B 19/00; H01H 9/00

[52] U.S. Cl. ..... 340/521; 200/61.93; 335/205; 340/541; 340/568

[58] Field of Search ..... 335/205; 200/61.93; 70/456 R, 458; 340/542, 547, 551, 572, 521, 541, 568

[56] References Cited

U.S. PATENT DOCUMENTS

| | | | |
|---|---|---|---|
| 1,623,950 | 4/1927 | Sargent | 340/568 X |
| 2,600,309 | 6/1952 | MacDonald et al. | 335/205 X |
| 2,931,953 | 4/1960 | Barney | 340/542 X |
| 3,069,890 | 12/1962 | McKinney et al. | 70/456 R |
| 3,682,216 | 8/1972 | Nelson | 70/456 R UX |
| 3,933,017 | 1/1976 | Shee | 70/456 R |
| 4,012,732 | 3/1977 | Herrick | 340/573 X |

*Primary Examiner*—Fred L. Braun

*Attorney, Agent, or Firm*—Larson, Taylor & Hinds

[57] ABSTRACT

A key holding member of elongated shape having a rod of permanent magnet embedded therein or a sheet of permanent magnet adhered thereto, which, when put into its corresponding opening for receiving the key holding member in the key box provided at the front of a hotel or the like, comes close to a reed switch provided in the key box. In this manner the reed switch is rendered operative to close or open the electrical circuits connected to the reed switch so as to turn "on" or "off" a lamp which shows that the room is left absent and to cause an alarming device to alarm whenever the room is broken into or a fire starts in the room.

4 Claims, 8 Drawing Figures

APPARATUS FOR CONTROLLING A POWER SOURCE FOR AN ELECTRICAL ALARM OR INDICATOR

BACKGROUND OF THE INVENTION (a) Field of the invention:

The present invention relates to a key holding member of elongated shape, from one end of which a key is freely hung through connecting metal member and chain and in which a rod of permanent magnet is embedded or to one face of which a sheet of permanent magnet is adhered. When the key holding member is put into its corresponding opening for receiving the key holding member in the key box provided at the front of a hotel or the like after the door of a room is locked by the key held by the key holding member to leave the room absent, the rod of permanent magnet embedded in the key holding member or the sheet of permanent magnet adhered to one face of the key holding member is caused to come close to a reed switch provided in the key box, so that the read switch is rendered operative to close or open an electrical circuit connected to the reed switch so as to turn "on" or "off" a lamp which shows that the room is absent, to keep an electrical circuit for an alarming device closed so as to cause the alarming device to alarm whenever the room is broken into or a fire starts in the room, and to put various electrical equipments furnished in the room to the "off" state relative to their power source, thus keeping the room safe when it is absent.

(b) Brief description of the prior art:

Various types of keys used to lock our room and house are essential to us who are living these days and it is a blow to us if we lose these keys. In order to avoid such case, various measures have been employed. One of the most popular measures is to connect a key through connecting metal member and chain to a plate of appropriate shape which is now often made of plastics. This is intended to always remind us of the key so as to prevent us from losing the key when we go about bringing the key with us after we leave out room or house absent. In other words, this is intended to make extremely smaller the possibility of our losing the key as compared with the case where we bring the key only.

Each of the keys employed in such accommodations as hotel is usually connected to a member of elongated shape, on which a room number is printed. This is also intended to prevent us from losing the key and to always remind us of the presence of the key.

However, these measures are all aimed to attain the objects of preventing us from losing the key, reminding us of the presence of the key, and making the key, which is relatively a small article, easy to handle.

SUMMARY OF THE INVENTION

The present invention relates to a key holding member having a rod of permanent magnet embedded therein or a sheet of permanent magnet adhered thereto, which, when put into its corresponding opening for receiving the key holding member in the key box provided at the front of a hotel, is caused to come close to a reed switch arranged in the key box, so that the reed switch is made operative to close electrical circuits so as to automatically turn on a lamp which shows that the room is absent and to automatically render an alarming device to the "on" state.

It is, therefore, a primary object of the present invention to provide a key holding member having a rod of permanent magnet embedded therein or a sheet of permanent magnet adhered thereto, which, when put into its corresponding opening for receiving the key holding member in the key box after the room is locked absent, causes electrical circuits to be closed or opened so as to automatically manage the room.

Another object of the present invention is to provide a key holding member having a rod of permanent magnet embedded therein or a sheet of permanent magnet adhered thereto, which, when put into its corresponding opening for receiving the key holding member in the key box after the room is locked absent, is caused to come close to a reed switch arranged in the key box, so that an alarming device is put "on" and the electrical equipments furnished in the room are securely put "off" from their power source, thus preventing a fire from starting in the room and electrical energy from being lost even when the room is locked absent leaving carelessly the electrical equipments connected to their power source.

Further object of the present invention is to provide a key holding member having a rod of permanent magnet embedded therein or a sheet of permanent magnet adhered thereto, which, when put into its corresponding opening for receiving the key holding member in the key box after the room is locked absent, is caused to come close to a reed switch arranged in the key box, so that a lamp is turned on to show that the room is vacant.

These and other objects as well as the merits of the present invention will be apparent from the following detailed description with reference to the accompanying drawings.

DETAILED DESCRIPTION OF THE PREFERRED EMBODIMENTS

Figure 1:
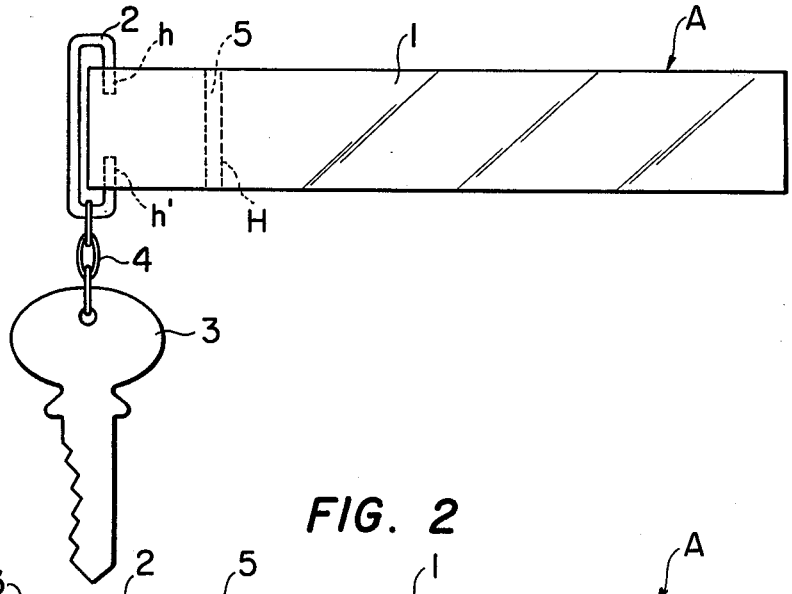
FIG. 1 is a front view showing an example of the key holding member of the present invention.
Figure 2:
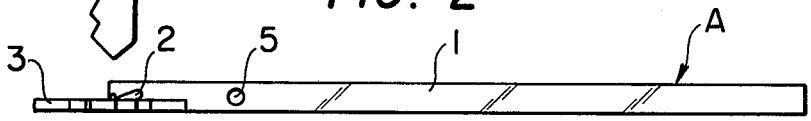
FIG. 2 is a bottom view of the key holding member shown in FIG. 1.

Referring to FIGS. 1 and 2 which show front and bottom views of an example of the key holding member (A) of the present invention, said key holding member (A) comprises a plate 1 of elongated shape and appropriate thickness made of such non-magnetic material as plastics, a C-shaped metal member, both ends of which are rotatably fitted into holes (h) and (h') provided at the longitudinal sides of the plate 1, a key attached through a chain or string 4 to the metal member 2, and a rod 5 of permanent magnet fixedly fitted into a through-hole (H) penetrating the plate 1 from one side to the other side thereof and being arranged adjacent to the metal member 2. It will be understood that the key 3 can be attached direct to the metal member 2 without using the chain or string 4.

Figure 3:
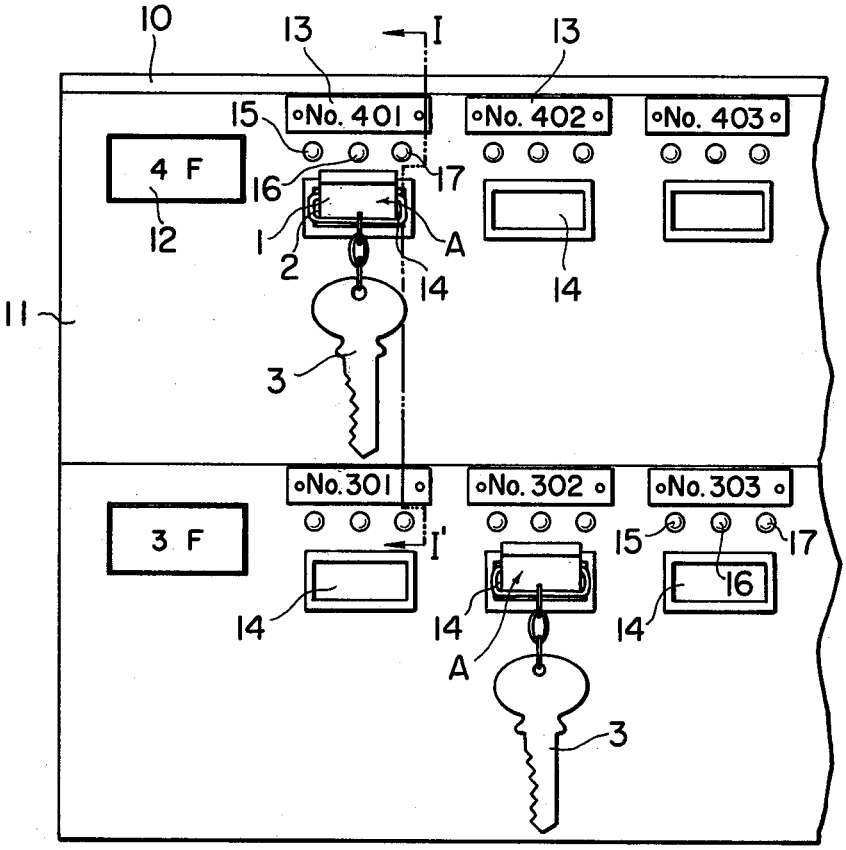
FIG. 3 is a front view of a key box in which a plurality of openings for receiving the key holding members are provided and showing how the key holding members of the present invention are put into their respective openings.

FIG. 3 shows how the key holding member (A) is used after a room is locked by the key 3. In general, there are provided key boxes at the front of a hotel or the like and after the key is used to lock the room to leave it vacant, the key is placed in the key box corresponding to the room number. Reference numeral 10 represents a key box, 11 a panel, 12 floor number plates, 13 room number plates, 14 openings for receiving the key holding members, into each of which the key holding member (A) having same room number as that indicated on its room number plate is inserted, and 15, 16 and 17 indication lamps which will be later described.

Figure 4:
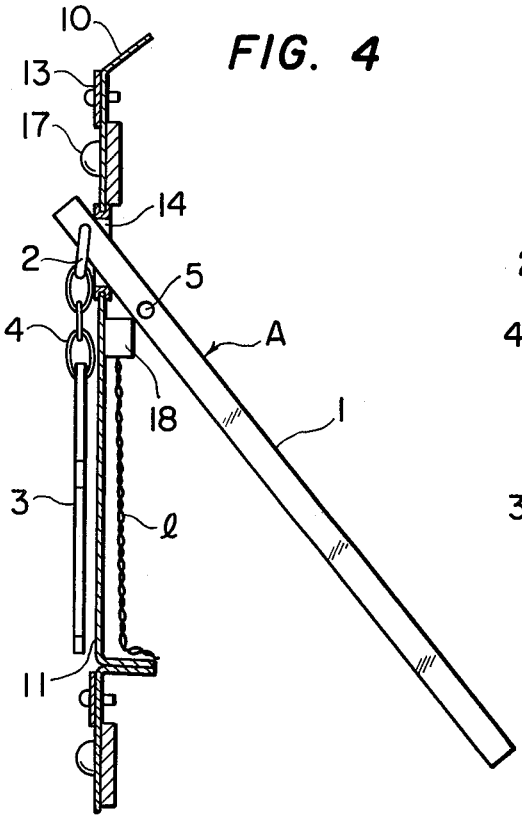
FIG. 4 is an enlarged section taken along the line I—I in FIG. 3.

As shown in FIG. 4, a reed switch 18 is attached to the back side of the panel 11 under and adjacent to the opening 14, and an electrical wire (l) is extending from the reed switch 18.

Referring to FIG. 3 again, the keys corresponding to the room numbers 302 and 401, namely, the key holding members (A) to which these keys are attached respectively are inserted into their respective openings 14 of the key box 10, showing that the rooms 302 and 401 are left vacant. These key holding members (A) are positioned in their respective openings 14 of the key box 10 as shown in FIG. 4. Namely, when the plate 1 of the key holding member (A) is inserted into the opening 14, the metal member 2 is rotated in the anti-clockwise direction to keep the key 3 hung outside the panel 11 through the chain 4, while the metal member 2 is caught by the opening 14 to hold the plate 1 as shown in FIG. 4. When the key holding member (A) is held as shown in FIG. 4, the rod 5 of permanent magnet fixedly fitted in the through-hole of the plate 1 is caused to come close to the reed switch 18 attached to the back side of the panel 11. As the result, the reed switch 18 is rendered operative to close the electrical circuit (not shown) to turn on the lamp 15. FIG. 3 shows that the lamps 15 corresponding to the room numbers 302 and 401 are turned on, thus allowing the front man to easily know, sending a glance to the panel 11, that the rooms 302 and 401 are vacant. It may be arranged that a reed switch of "off" type is employed to render the lighted lamp 15 to the "off" state.

The operation of the reed switch 18 may cause relays and micro-switches arranged in the circuit to render all of the electrical equipments furnished in the room to the "off" state relative to their power source, so that any of the electrical equipments which are carelessly left in the "on" state when the room is locked vacant will be automatically turned off.

It may be also arranged that the operation of the reed switch 18 causes the electrical circuit to be closed to render a crime prevention device operative.

The indication lamp 16 is lighted when the room which is vacant is broken into, while the other indication lamp 17 is lighted when any wire of the electrical circuits is broken. These functions may be attained by the lamp 15 only, which is flickered when the room which is vacant is broken into or any wire of the electrical circuits is broken.

The electrical circuits are designed according to the objects and previously arranged in an appropriate manner. It is desirable that luminous diodes are applied to the indication lamps.

Figure 5:
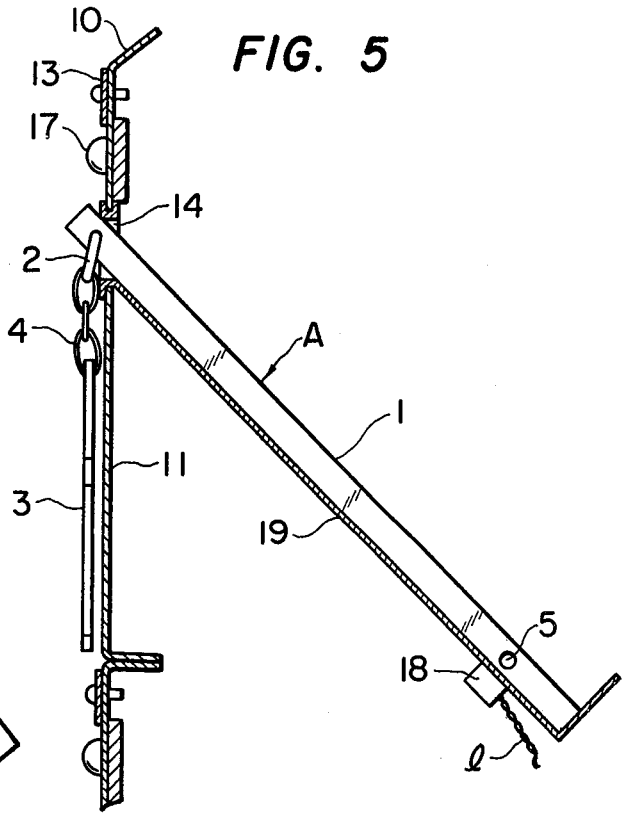
FIG. 5 is a section showing another example of the key holding member of the present invention which is put into its corresponding opening as shown in FIG. 4.

FIG. 5 shows another example of the key holding member of the present invention, in which the lower edge of the opening 14 is slanted extended in the lower direction to form a support 19 for supporting the key holding member and the reed switch 18 is attached to the lower portion of the support 19. The rod 5 of permanent magnet is embedded in the plate 1 at an end opposite the other end at which the metal member 2 is arranged. In order to connect the key 3 to the plate 1 it is not necessary to use the metal member 2 but enough to use the chain 4 only.

Figure 6:
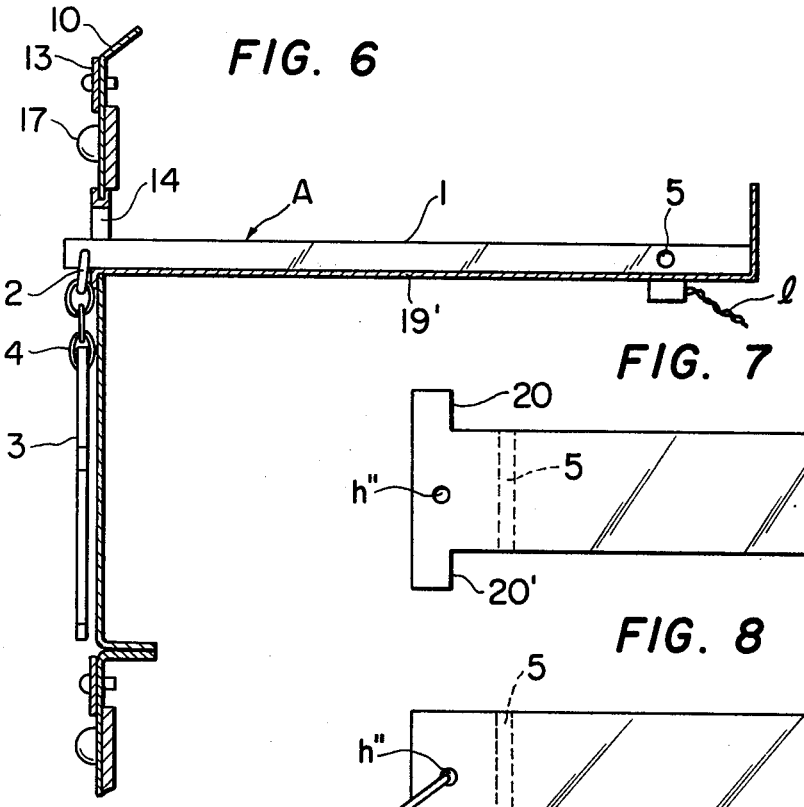
FIG. 6 is a section showing how the key holding member shown in FIG. 5 is put into its corresponding opening which has an arrangement different from the one shown in FIG. 5.

FIG. 6 shows a further example of the key holding member of the present invention, in which the lower edge of the opening 14 provided in the panel 11 is horizontally extended to form a support 19', and the plate 1 of the key holding member (A) is supported by the support 19' when it is inserted into the opening 14. The reed switch 18 is attached to the support 19' at the righthand end thereof and the rod 5 of permanent magnet is arranged in the plate 1 at such a position as the rod 5 of permanent magnet corresponds to the reed switch 18. In these examples shown in FIGS. 5 and 6, the position of the rod of permanent magnet is not limited to those shown in the Figures but may be arranged in such a manner that the rod 5 corresponds to the reed switch 18. In the case, too, where the example shown in FIG. 6 is employed, it is not necessary to use the metal member 2 but enough to use the chain 4 only.

Each of the examples which have been already described above has the rod of permanent magnet embedded in the plate 1. However, a sheet of permanent magnet may be adhered to one face of the plate 1. The shape of the plate 1 is not limited to those shown in the Figures but may be modified to a bar or the like.

Though the reed switch 18 has been described as the one to directly close or open the electrical circuits, it may be arranged so that a reed switch is caused to cooperate with relays and micro-switches connected thereto to control all of the electrical circuits. In this case only one unit of the reed switch can control plural electrical equipments. It will be understood that plural reed switches may be used to control plural electrical equipments connected to the respective reed switches.

Figure 7:
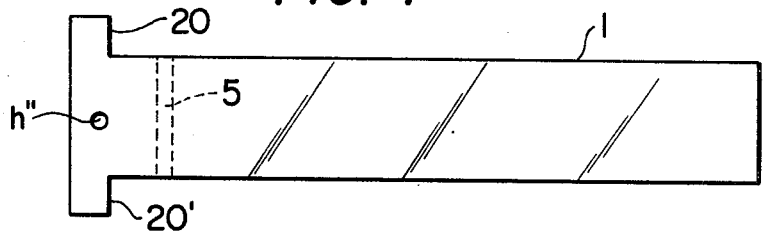
FIG. 7 is a front view showing a further example of the key holding member of the present invention.
Figure 8:
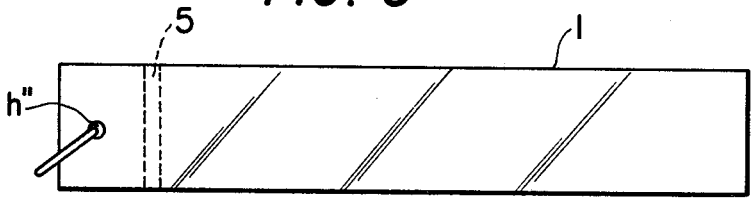
FIG. 8 is a front view showing a still further example of the key holding member of the present invention.

Referring to FIG. 7, the plate 1 has projections 20 and 20' at one end thereof, which project perpendicular to the longitudinal axis of the plate 1. When the plate 1 is inserted into the opening 14, these projections are stopped by both side edges of the opening 14. In FIG. 7 reference symbol (h") represents a hole through which a member equivalent to the metal member 2 is attached. The metal member 2 is not limited to the one shown in the Figures but may be formed to such a ring as shown in FIG. 8. It is desirable in this case that the ring attached through the hole (h") to one end of the plate 1 has a diameter larger enough to cause the ring to be stopped by the opening 14.

I claim:

1. An apparatus for controlling actuation of a power source for an electrical alarm device, or the like, said apparatus including: a key holding member of elongated shape having a permanent magnet associated therewith, a key box adapted to be provided at the front of a hotel or the like including a corresponding opening for receiving the key holding member after the door of a room is locked by a key held by the key holding member thereby leaving the room vacant, a reed switch provided in the key box and located relative to the key holding member such that when said key holding member is received in said opening the permanent magnet associated with said key holding member renders the reed switch operative, and an electrical circuit, connected to the reed switch and including an indicator lamp for indicating whether or not the associated room is vacant and an electrical alarm device for, when enabled, indicating whenever the associated room is broken into or a fire starts in the room, for causing said lamp to change state so as to indicate that the associated room is vacant and for enabling said alarm device responsive to said reed switch being rendered operative.

2. an apparatus according to claim 1 wherein said permanent magnet comprises a permanent magnet rod embedded in said key holding member.

3. An apparatus according to claim 2 wherein the permanent magnet rod is arranged in the key holding member adjacent to the end thereof to which the key is attached.

4. An apparatus according to claim 2 wherein the permanent magnet rod is arranged in the key holding member remote from the end thereof to which the key is attached.

* * * * *